US011351587B2

(12) United States Patent
Huang

(10) Patent No.: US 11,351,587 B2
(45) Date of Patent: Jun. 7, 2022

(54) SINGLE BENDING DEVICE FOR CONTINUOUS THREE-DIMENSIONAL BENDING

(71) Applicant: Hsin-Po Huang, Taoyuan (TW)

(72) Inventor: Hsin-Po Huang, Taoyuan (TW)

( * ) Notice: Subject to any disclaimer, the term of this patent is extended or adjusted under 35 U.S.C. 154(b) by 127 days.

(21) Appl. No.: 16/835,798

(22) Filed: Mar. 31, 2020

(65) Prior Publication Data

US 2021/0299725 A1 Sep. 30, 2021

(51) Int. Cl.
*B21D 7/08* (2006.01)
*B21D 7/04* (2006.01)

(52) U.S. Cl.
CPC ..... *B21D 7/08* (2013.01); *B21D 7/04* (2013.01)

(58) Field of Classification Search
CPC ... B21D 7/02; B21D 7/04; B21D 7/08; B21D 7/085; B21D 7/021; B21D 7/022; B21D 7/024; B21D 7/14; B21D 11/02; B21D 43/13
See application file for complete search history.

(56) References Cited

U.S. PATENT DOCUMENTS 3,147,792 A 9/1964 Hautau
4,495,788 A * 1/1985 Traub ..... B21D 7/024 72/157
4,843,859 A * 7/1989 Togoshi ..... B21D 7/021 72/149
7,254,972 B1 * 8/2007 Wang ..... B21D 7/021 72/149
2005/0217337 A1 10/2005 Bruyas et al.

FOREIGN PATENT DOCUMENTS

CN 101722220 A 6/2010
CN 209006459 U 6/2019
FR 940782 A * 12/1948 ..... B21D 7/022

* cited by examiner

*Primary Examiner* — Teresa M Ekiert
(74) *Attorney, Agent, or Firm* — Rosenberg, Klein & Lee

(57) ABSTRACT

A single bending device for continuous three-dimensional bending has a rotating and feeding holder for holding a workpiece, a bending roller assembly having multiple rollers being different in radius, a pressing roller head for bending the workpiece. The bending roller assembly can be moved to allow one predetermined roller to abut against the workpiece. Then the workpiece can be bent by the pressing roller head pushing the workpiece along the predetermined roller. Thus, as long as a different one of the rollers corresponds in position to the workpiece, a bending portion having a different curvature can be formed on the workpiece. Moreover, by controlling the moving length of the pressing roller head along the workpiece, the arc length of each bending portion of the workpiece can be controlled accordingly. It is not necessary to replace the jigs and the dies repeatedly.

20 Claims, 10 Drawing Sheets

SINGLE BENDING DEVICE FOR CONTINUOUS THREE-DIMENSIONAL BENDING

BACKGROUND OF THE INVENTION

1. Field of the Invention

The present invention relates to a processing apparatus, especially to a bending device that is used for continuously bending a workpiece to allow arc portions formed on the workpiece to have different curvatures and different lengths.

2. Description of the Prior Art(s)

To bend a rod or a tube to an appropriate shape for easy use, a conventional bending device is used. The conventional bending device comprises multiple replaceable jigs and multiple replaceable dies. However, only one jig and one die are used at a time. The jig and the die that are in use fit together and can only bend the rod or the tube in a specific bending angle to form a specific curvature. In other words, when arc portions having different curvatures should be formed on the rod or the tube, the jig and the die in use should be replaced again and again. Replacing the jigs and the dies is time-consuming and labor-intensive. Consequently, production capacity is reduced and production cost is increased. If a plurality of the conventional bending devices having different jigs and different dies are used, cost for those conventional bending devices would be too high and there would be not enough room in a plant for disposing those conventional bending devices.

To overcome the shortcomings, the present invention provides a single bending device for continuous three-dimensional bending to mitigate or obviate the aforementioned problems.

SUMMARY OF THE INVENTION

The main objective of the present invention is to provide a single bending device for continuous three-dimensional bending. The single bending device is used for bending an elongated workpiece, which may be tubular or bar-shaped, and has a rotating and feeding holder, a bending roller assembly, a pressing roller head, a first moving assembly, a second moving assembly, and a third moving assembly. The rotating and feeding holder is for holding the workpiece. The first moving assembly moves the rotating and feeding holder back and forth. The bending roller assembly may include multiple rollers being different in radius and coaxially disposed. Otherwise, the bending roller assembly may include at least one roller with each of the at least one roller having an outer annular surface being divided into multiple curved sub-surfaces and the curved sub-surfaces having different radii of curvature. The second moving assembly moves the bending roller assembly back and forth to allow an outer annular surface of one of the rollers to abut against the workpiece. The pressing roller head is for bending the workpiece. The third moving assembly moves the pressing roller head back and forth to allow the pressing roller head to move along the outer annular surface of the roller.

The bending roller assembly that has the multiple rollers being different in radius or has at least one roller with each of the at least one roller having multiple curved sub-surfaces having different radii of curvature can be moved by the second moving assembly to allow the predetermined one of the rollers or the predetermined one of the curved sub-surfaces to abut against the workpiece. Then the workpiece can be bent by the pressing roller head pushing the workpiece along the outer annular surface of the predetermined one of the rollers.

Thus, as long as a different one of the rollers corresponds in position to the workpiece, the bending portion having a different curvature can be formed on the workpiece. Moreover, by controlling the moving length of the pressing roller head along the workpiece, the arc length of each bending portion of the workpiece can be controlled accordingly. It is not necessary to replace the jigs and the dies repeatedly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
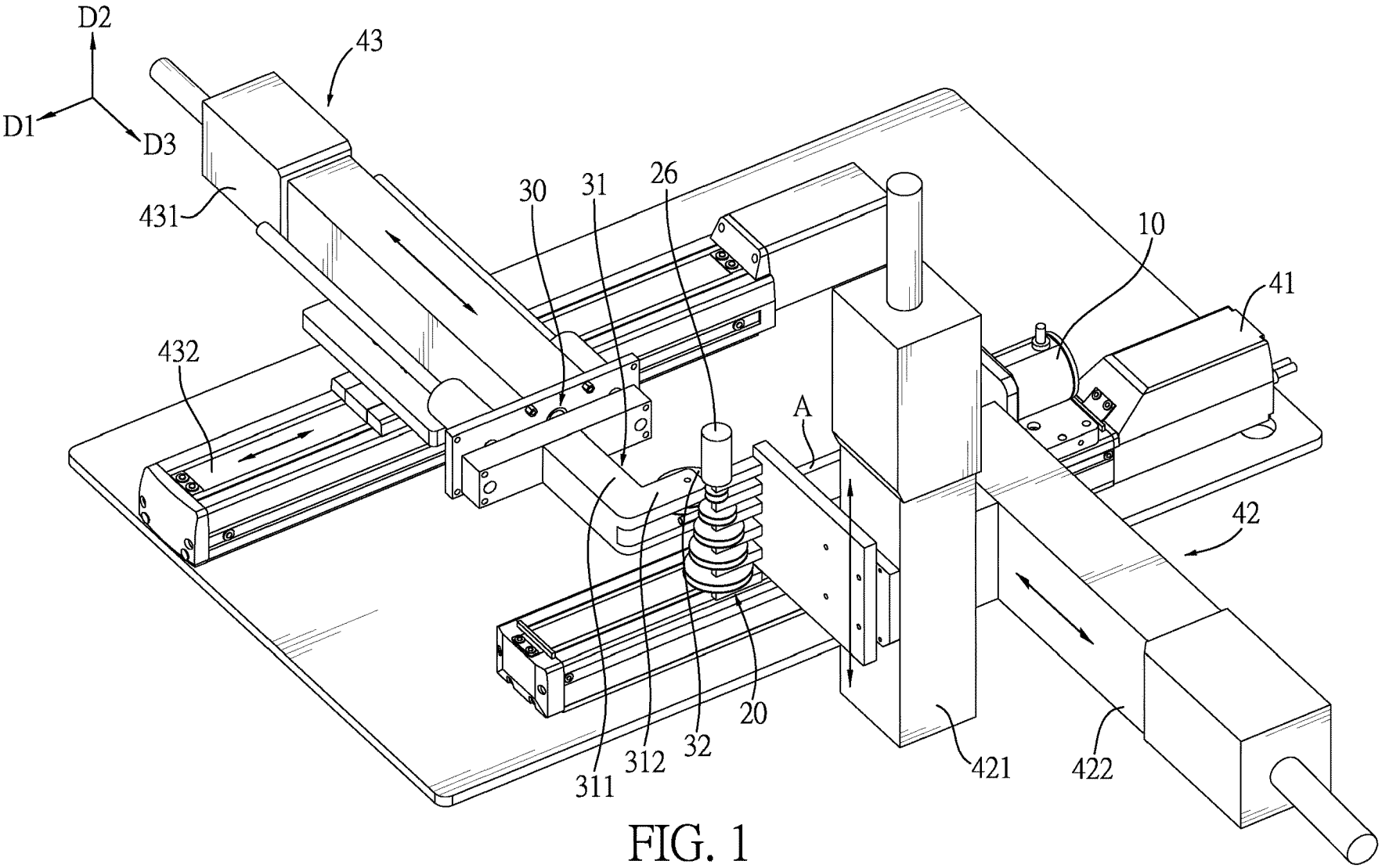
FIG. 1 is a perspective view of a single bending device for continuous three-dimensional bending in accordance with the present invention.
Figure 2:
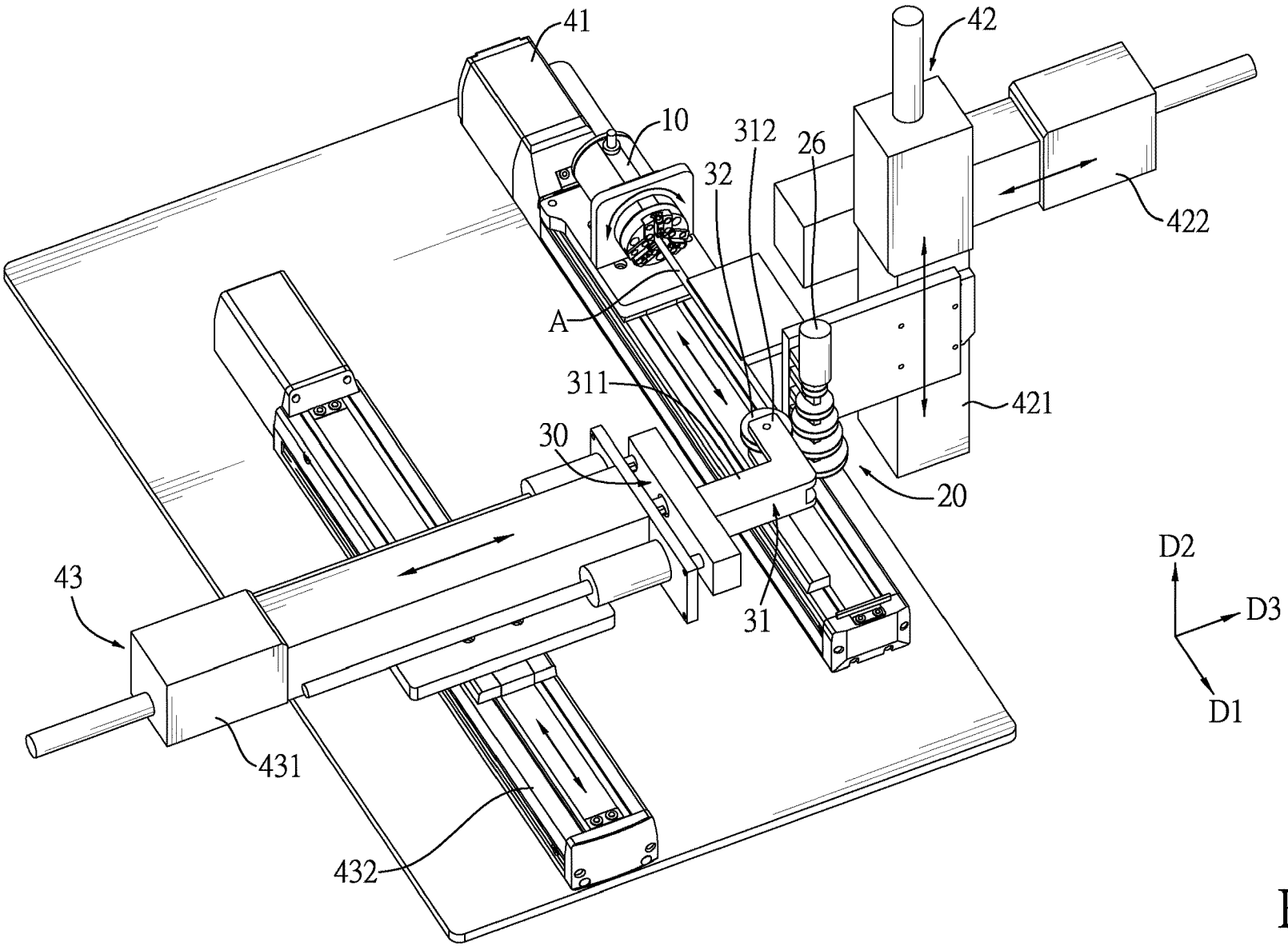
FIG. 2 is another perspective view of the single bending device in FIG. 1.
Figure 3:
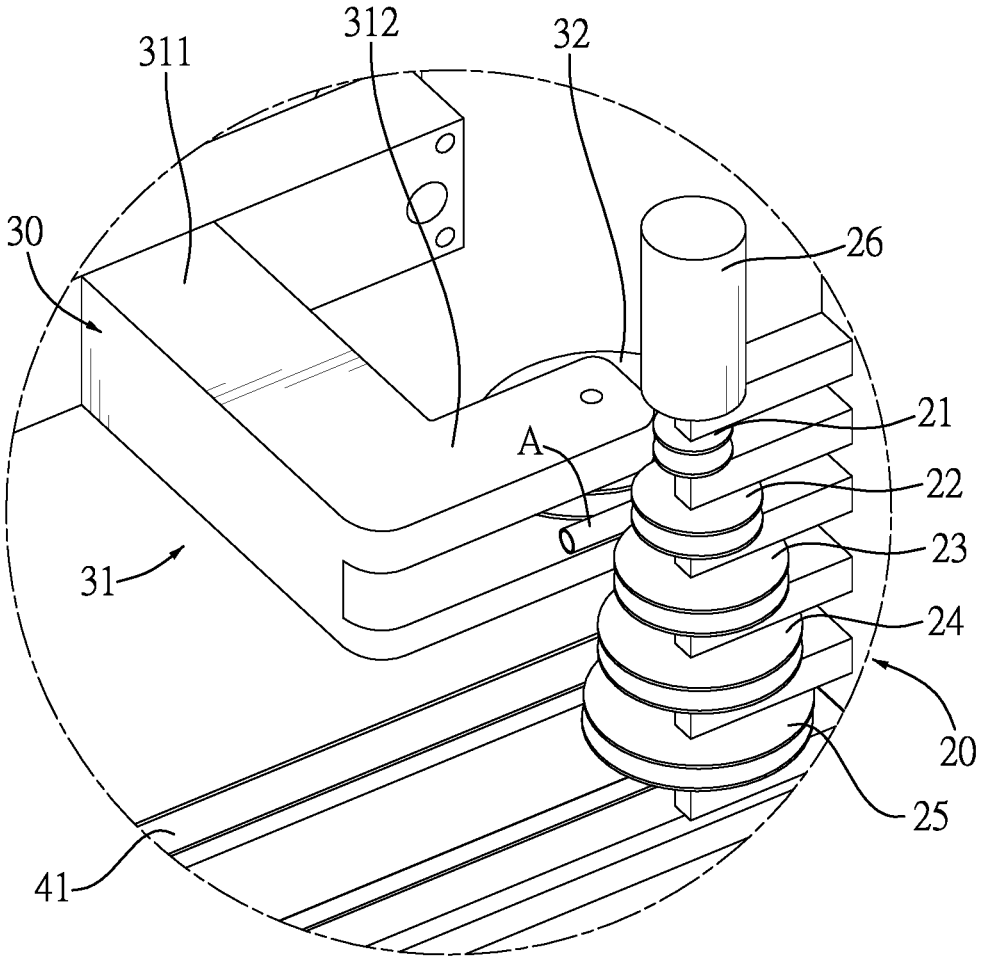
FIG. 3 is an enlarged perspective view of a bending roller assembly and a pressing roller head of the single bending device in FIG. 1.

With reference to FIGS. 1 to 3, a single bending device for continuous three-dimensional bending in accordance with the present invention is shown. The single bending device is used for bending an elongated workpiece A, so as to form multiple bending portions on the workpiece A with each bending portion having a specific curvature and a specific arc length. The workpiece A may be tubular or rod-shaped. For instance, the single bending device may be used for manufacturing condensing tubes of a condenser.

The single bending device comprises a rotating and feeding holder 10, a bending roller assembly 20, and a pressing roller head 30. In the preferred embodiment, the single bending device further comprises a first moving assembly 41, a second moving assembly 42, and a third moving assembly 43.

The rotating and feeding holder 10 is used for holding and rotating the workpiece A. An elongation direction of the elongated workpiece A when the workpiece A is unprocessed is defined as a first direction D1. The first moving assembly 41 moves the rotating and feeding holder 10 back and forth along the first direction D1, and the rotating and feeding holder 10 rotates the workpiece A around a rotation axis that is parallel with the first direction D1. The first moving assembly 41 may include a pressure cylinder, a servo motor, or a stepper motor.

The bending roller assembly 20 includes multiple rollers 21, 22, 23, 24, 25 and the rollers 21, 22, 23, 24, 25 are different in radius. In the preferred embodiment, the multiple rollers 21, 22, 23, 24, 25 includes a first roller 21, a second roller 22, a third roller 23, a fourth roller 24, and a fifth roller 25. The rollers 21, 22, 23, 24, 25 are coaxially disposed and each of the rollers 21, 22, 23, 24, 25 rotates around a rotation axis. The rotation axis of the rollers 21, 22, 23, 24, 25 is defined as a second direction D2.

For instance, in the preferred embodiment, the rotation axis extends longitudinally and is perpendicular to the first direction D1, and the rollers 21, 22, 23, 24, 25 are longitudinally arranged. Otherwise, in another embodiment, the rotation axis may extend transversely and the rollers 21, 22, 23, 24, 25 may be transversely arranged. The bending roller assembly 20 may further include a motor 26. The motor 26 is connected to the rollers 21, 22, 23, 24, 25 and is capable of driving the rollers 21, 22, 23, 24, 25 to rotate around the rotation axis.

The second moving assembly 42 moves the bending roller assembly 20 back and forth along the second direction D2 to allow an outer annular surface of one of the rollers 21, 22, 23, 24, 25 to correspond in position to the workpiece A. In the preferred embodiment, the second moving assembly 42 is further capable of moving the bending roller assembly 20 back and forth along a third direction D3 to allow the outer annular surface of said one of the rollers 21, 22, 23, 24, 25 to abut against the workpiece A. The third direction D3 is perpendicular to the first direction D1 and the second direction D2.

Specifically, in the preferred embodiment, the second moving assembly 42 has a roller switching mechanism 421 and a roller abutting mechanism 422. The bending roller assembly 20 is movably mounted on the roller switching mechanism 421. The roller switching mechanism 421 moves the bending roller assembly 20 back and forth along the second direction D2. The roller switch mechanism 421 is movably mounted on the roller abutting mechanism 422. The roller abutting mechanism 422 moves the roller switching mechanism 421 back and forth along the third direction D3. Each of the roller switching mechanism 421 and the roller abutting mechanism 422 may include a pressure cylinder, a servo motor, or a stepper motor.

Otherwise, in another embodiment, the bending roller assembly 20 may be movably mounted on the roller abutting mechanism 422 and the roller abutting mechanism 421 may be movably mounted on the roller switching assembly 421.

Thus, a predetermined one of the rollers 21, 22, 23, 24, 25 can be moved to correspond in position to the workpiece A and a distance between the rotation axis of the predetermined one of the rollers 21, 22, 23, 24, 25 and the workpiece A can be adjusted by the second moving assembly 42, so as to make sure that the outer annular surface of the roller 21, 22, 23, 24, 25 abuts exactly against the workpiece A and to bend the workpiece A to have a curvature corresponding with a radius of said predetermined one of the rollers 21, 22, 23, 24, 25.

The pressing roller head 30 pushes the workpiece A to abut against the predetermined one of the rollers 21, 22, 23, 24, 25 to bend the workpiece A to have the curvature corresponding with said predetermined one of the rollers 21, 22, 23, 24, 25. Specifically, the third moving assembly 43 moves the pressing roller head 30 back and forth two-dimensionally along the first direction D1 and the third direction D3 to allow the pressing roller head 30 to move along the outer annular surface of the roller 21, 22, 23, 24, 25.

The pressing roller head 30 includes a base 31 and a pressing roller 32. In the preferred embodiment, the base 31 has a first extension portion 311 and a second extension portion 312. The first extension portion 311 extends along the third direction D3 and has a first end and a second end. The first end of the first extension portion 311 is securely attached to the third moving assembly 43. The second end of the first extension portion 311 is defined opposite to the first end of the first extension portion 311 and is disposed closer to the bending roller assembly 20 than the first end of the first extension portion 311. The second extension portion 312 extends along the first direction D1 and has a first end and a second end. The first end of the second extension portion 312 is securely attached to the second end of the first extension portion 311. The second end of the second extension portion 312 is defined opposite to the first end of the second extension portion 312 and is disposed closer to the bending roller assembly 20 than the first end of the second extension portion 312. Otherwise, in other embodiments, the first extension portion 311 is not necessary to be perpendicular to the second extension portion 312.

Specifically, in the preferred embodiment, the third moving assembly 43 has a third direction moving mechanism 431 and a first direction moving mechanism 432. The pressing roller head 30 is movably mounted on the third direction moving mechanism 431. The third direction moving mechanism 431 moves the pressing roller head 30 back and forth along the third direction D3. The third direction moving mechanism 431 is movably mounted on the first direction moving mechanism 432. The first direction moving mechanism 432 moves the third direction moving mechanism 431 back and forth along the first direction D1. Thus, the third moving assembly 43 is capable of moving the pressing roller head 30 two-dimensionally to allow the pressing roller head 30 to move along the annular outer surface of the roller 21, 22, 23, 24, 25 which the workpiece A abuts against. Each of the third direction moving mechanism 431 and the first direction moving mechanism 432 may include a pressure cylinder, a servo motor, or a stepper motor.

However, the first direction D1, the second direction D2, and the third direction D3 are not limited to be perpendicular with each other. In other embodiments, each two of the first direction D1, the second direction D2, and the third direction D3 may tilt relative to each other.

Figure 4:
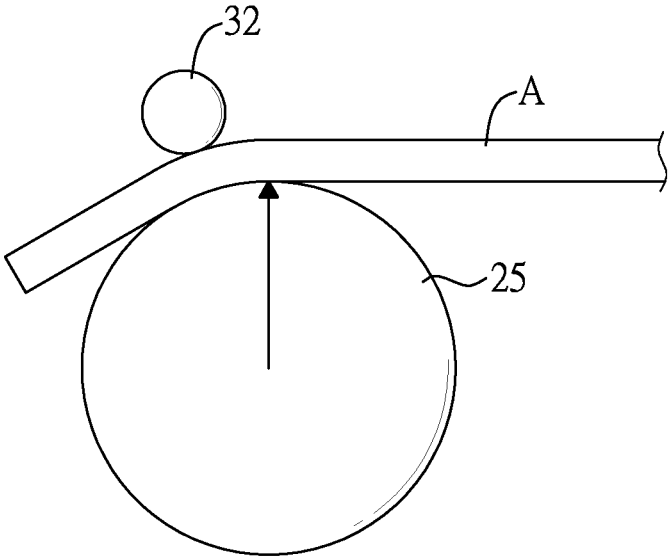
FIG. 4 is an operational schematic diagram of the single bending device in FIG. 1, showing the pressing roller head pushing a workpiece to abut against one roller of the bending roller assembly.
Figure 5:
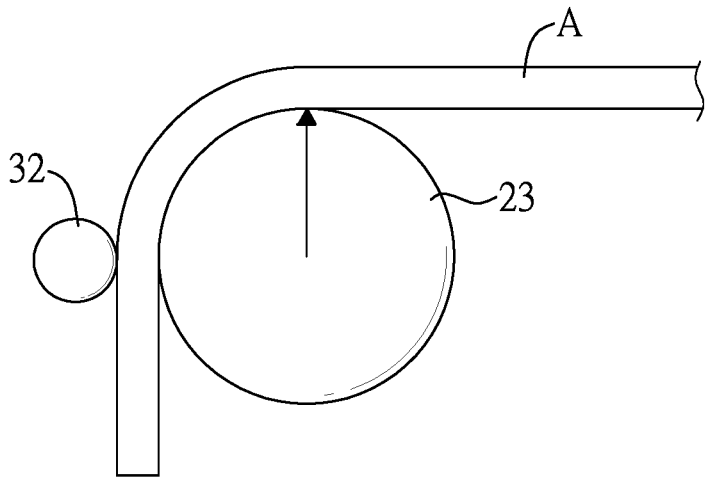
FIG. 5 is an operational schematic diagram of the single bending device in FIG. 1, showing the pressing roller head pushing the workpiece to abut against another roller of the bending roller assembly and the workpiece having a 90-degree bending portion.
Figure 6:
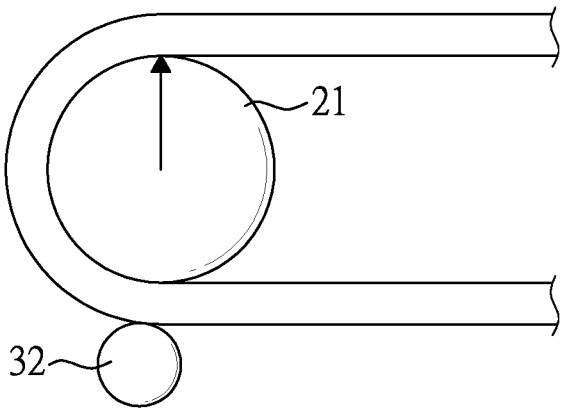
FIG. 6 is an operational schematic diagram of the single bending device in FIG. 1, showing the pressing roller head pushing the workpiece to abut against still another roller of the bending roller assembly and the workpiece having a 180-degree bending portion.

With further reference to FIGS. 4 to 6, with the single bending device as described, the workpiece A can be bent as follows. In the beginning, the rotating and feeding holder 10 is moved by the first moving assembly 41 to allow a predetermined bending portion of the workpiece A that is held by the rotating and feeding holder 10 to correspond in position to the bending roller assembly 20. Then the bending roller assembly 20 is moved by the second moving assembly 42 to allow the outer annular surface of the predetermined one of the rollers 21, 22, 23, 24, 25 to abut against the workpiece A. Then by moving the pressing roller head 30 through the third moving assembly 43, the pressing roller head 30 pushes the workpiece A along the outer annular surface of the predetermined one of the rollers 21, 22, 23, 24, 25, to allow the workpiece A to fit on the outer annular surface of the predetermined one of the rollers 21, 22, 23, 24, 25.

Therefore, without replacing jigs and dies, the single bending device of the present invention is able to:

(1) form the bending portions that have different curvature on the workpiece A with the rollers 21, 22, 23, 24, 25 that have different radii, such as 30 millimeters or 50 millimeters;

(2) control a moving length of the pressing roller head 30 along the workpiece A to control the arc length of each bending portion of the workpiece A, such that the bending portion can be bent 30 degrees, 60 degrees, 90 degrees, or 180 degrees; and (3) bend the workpiece A into a spiral by bending the workpiece A with the pressing roller head 30 and rotating the workpiece A with the rotating and feeding holder 10 simultaneously.

Figure 7:
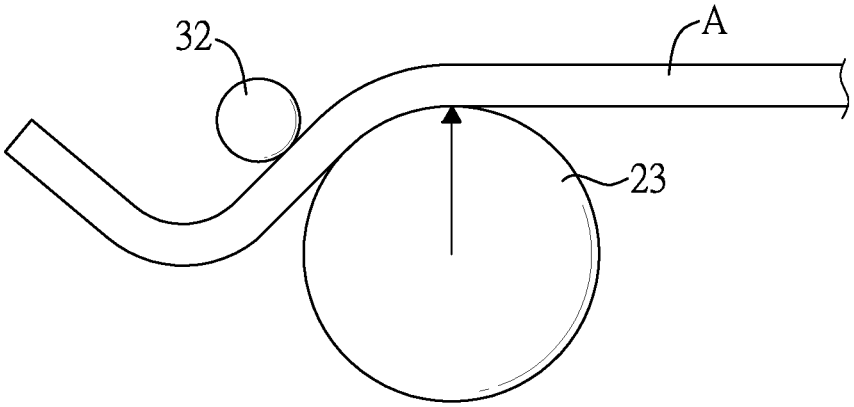
FIG. 7 is an operational schematic diagram of the single bending device in FIG. 1, showing the workpiece being bent many times.

Furthermore, as shown in FIG. 7, the workpiece A can be bent many times in different angles and to have different curvatures.

Figure 8:
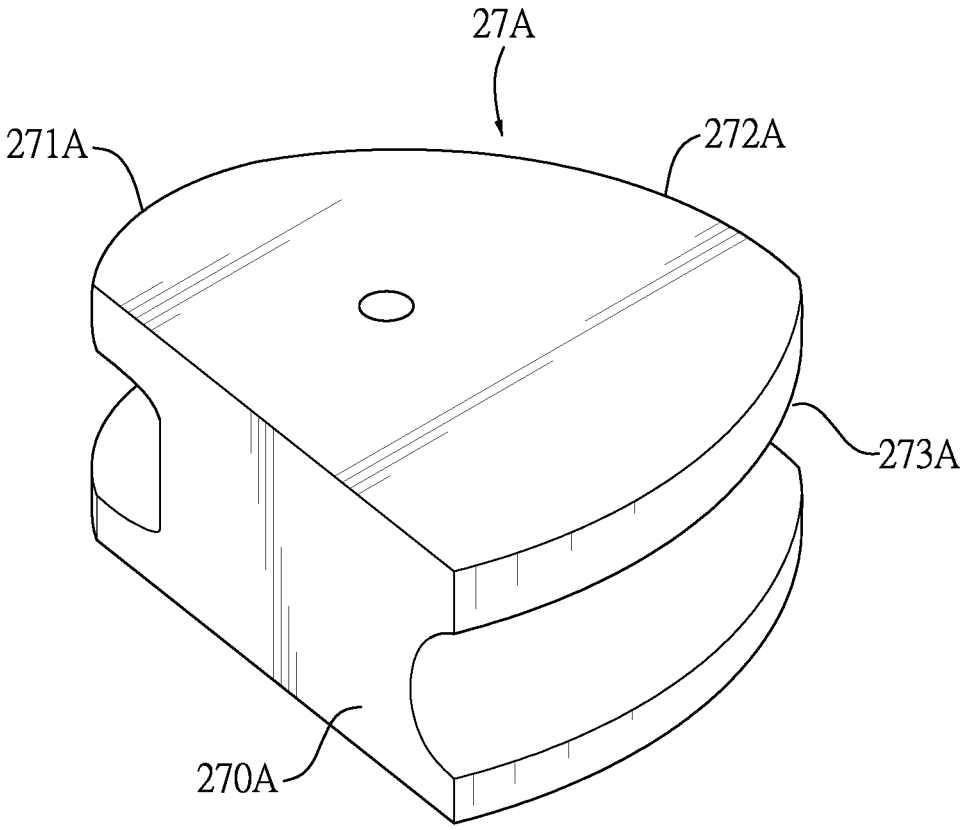
FIG. 8 is a perspective view of another embodiment of a bending roller assembly of a single bending device in accordance with the present invention.
Figure 9:
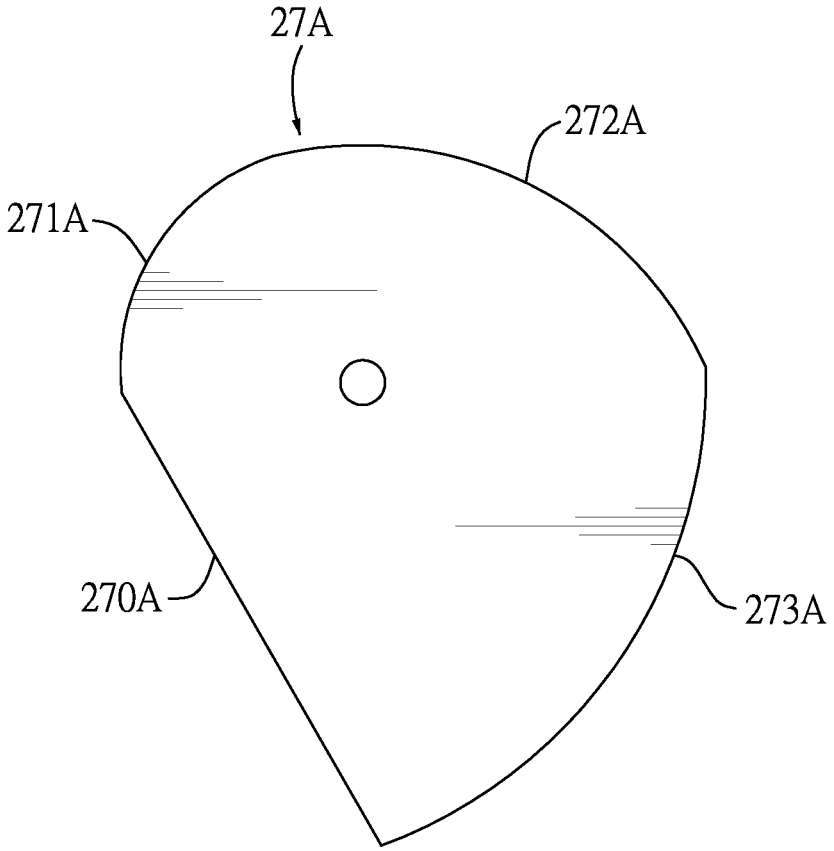
FIG. 9 is a top view of the bending roller assembly in FIG. 8.
Figure 10:
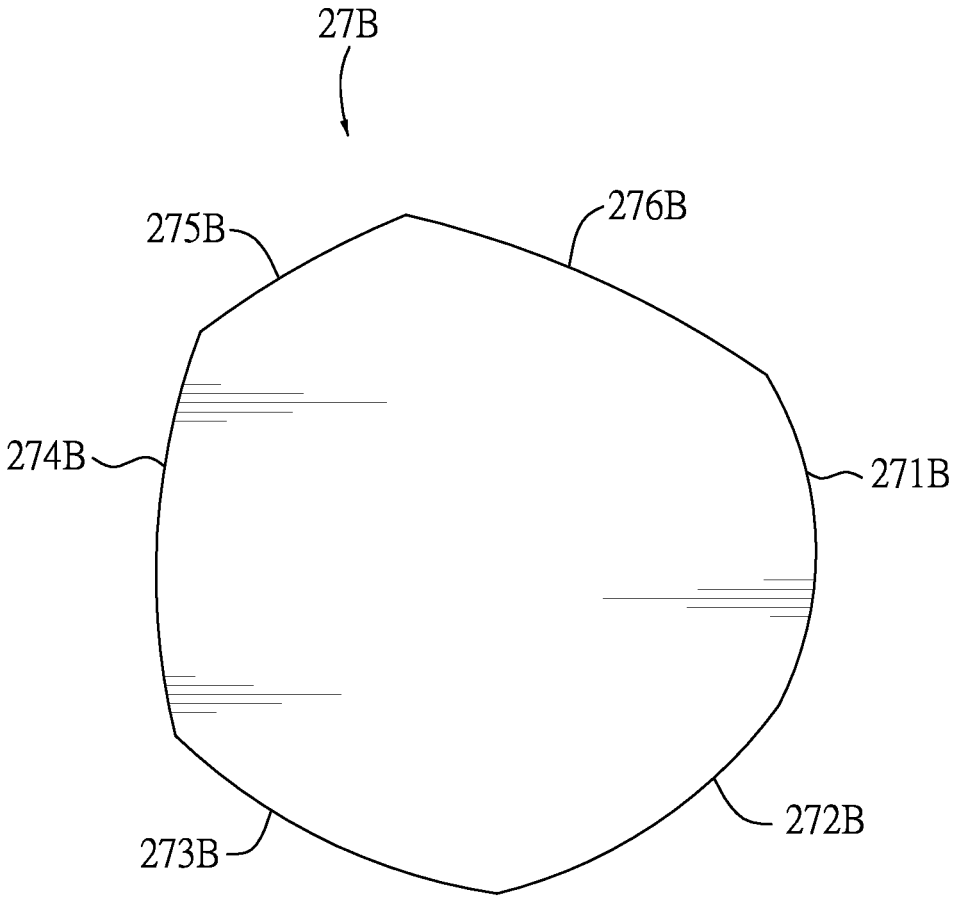
FIG. 10 is a top view of still another embodiment of a bending roller assembly of a single bending device in accordance with the present invention.

In the afore-mentioned preferred embodiment, the rollers 21, 22, 23, 24, 25 of the bending roller assembly 20 are circular in cross-section. However, each of the rollers is not limited to be circular in cross-section. In other preferred embodiments, the roller 27A as shown in FIGS. 8 and 9 and the roller 27B as shown in FIG. 10 are non-circular in cross-section. The outer annular surface of each roller 27A, 27B is divided into multiple curved sub-surfaces having different radii of curvature. Centers of curvature of the curved sub-surfaces may be located at different positions, such that the curved sub-surfaces are connected with each other without any step formed between each two of the curved sub-surfaces that are adjacent to each other. Accordingly, no protrusion, which hinders bending process from performing, would be formed on the outer annular surface of the roller 27A, 27B. For instance, the roller 27A may have a first curved sub-surface 271A, a second curved sub-surface 272A, a third curved sub-surface 273A and a connecting surface 270A sequentially connected. The roller 27B may have a first curved sub-surface 271B, a second curved sub-surface 272B, a third curved sub-surface 273B, a fourth curved sub-surface 274B, a fifth curved sub-surface 275B and a sixth curved sub-surface 276B sequentially connected. As there are curved sub-surfaces having different radii of curvature formed on one roller 27A, 28B, number of the rollers 21, 22, 23, 24, 25, 27A, 27B of the bending roller assembly 20 can be reduced, or the bending roller assembly 20 can even have one roller 27A, 27B.

Thus, when performing the bending process with the roller 27A, the motor 26 drives the roller 27A to allow a predetermined one of the curved sub-surfaces of the roller 27A to face toward the workpiece A, and the second moving assembly 42 moves the bending roller assembly 20 to allow said predetermined curved sub-surface of the roller 27A to abut against the workpiece A. Accordingly, the workpiece A can be bent along said predetermined curved sub-surface.

The single bending device as described has the following advantages. The bending roller assembly 20 that has the multiple rollers 21, 22, 23, 24, 25 being different in radius or has at least one roller 27A, 27B with each of the at least one roller 27A, 27B having multiple curved sub-surfaces having different radii of curvature can be moved by the second moving assembly 42 to allow the predetermined one of the rollers 21, 22, 23, 24, 25 or the predetermined one of the curved sub-surfaces to abut against the workpiece A. Then the workpiece A can be bent by the pressing roller head 30 pushing the workpiece A along the outer annular surface of the predetermined one of the rollers 21, 22, 23, 24, 25, 27A, 27B. Thus, as long as a different one of the rollers 21, 22, 23, 24, 25, 27A, 27B corresponds in position to the workpiece A, the bending portion having a different curvature can be formed on the workpiece A. Moreover, by controlling the moving length of the pressing roller head 30 along the workpiece A, the arc length of each bending portion of the workpiece A can be controlled accordingly. It is not necessary to replace the jigs and the dies repeatedly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A single bending device for continuous three-dimensional bending, and the single bending device used for bending an elongated workpiece and comprising:

a rotating and feeding holder holding the workpiece;

a first moving assembly moving the rotating and feeding holder back and forth;

a bending roller assembly including multiple rollers, and the rollers being different in radius and coaxially disposed;

a second moving assembly moving the bending roller assembly back and forth to allow an outer annular surface of one of the rollers to abut against the workpiece;

a pressing roller head bending the workpiece; and a third moving assembly moving the pressing roller head back and forth two-dimensionally to allow the pressing roller head to move along the outer annular surface of the roller.

2. The single bending device as claimed in claim 1, wherein one roller of the bending roller assembly has multiple curved sub-surfaces having different radii of curvature.

3. The single bending device as claimed in claim 1, wherein the rotating and feeding holder rotates the workpiece around a rotation axis that is parallel with an elongation direction of the elongated workpiece.

4. The single bending device as claimed in claim 1, wherein an elongation direction of the elongated workpiece when the workpiece is unprocessed is defined as a first direction; and a rotation axis of each of the rollers is defined as a second direction, and the second direction is perpendicular to the first direction.

5. The single bending device as claimed in claim 2, wherein an elongation direction of the elongated workpiece when the workpiece is unprocessed is defined as a first direction; and a rotation axis of each of the rollers is defined as a second direction, and the second direction is perpendicular to the first direction.

6. The single bending device as claimed in claim 3, wherein the elongation direction of the elongated workpiece when the workpiece is unprocessed is defined as a first direction; and the rotation axis of each of the rollers is defined as a second direction, and the second direction is perpendicular to the first direction.

7. The single bending device as claimed in claim 4, wherein the second moving assembly moves the bending roller assembly back and forth along the second direction to allow the outer annular surface of one of the rollers to correspond in position to the workpiece;

the second moving assembly further moves the bending roller assembly back and forth along a third direction to allow the outer annular surface of said one of the rollers to abut against the workpiece; and the third direction is perpendicular to the first direction and the second direction.

8. The single bending device as claimed in claim 5, wherein the second moving assembly moves the bending roller assembly back and forth along the second direction to allow the outer annular surface of one of the rollers to correspond in position to the workpiece;

the second moving assembly further moves the bending roller assembly back and forth along a third direction to allow the outer annular surface of said one of the rollers to abut against the workpiece; and the third direction is perpendicular to the first direction and the second direction.

9. The single bending device as claimed in claim 6, wherein the second moving assembly moves the bending roller assembly back and forth along the second direction to allow the outer annular surface of one of the rollers to correspond in position to the workpiece;

the second moving assembly further moves the bending roller assembly back and forth along a third direction to allow the outer annular surface of said one of the rollers to abut against the workpiece; and the third direction is perpendicular to the first direction and the second direction.

10. The single bending device as claimed in claim 7, wherein the second moving assembly has a roller switching mechanism, the bending roller assembly movably mounted on the roller switching mechanism, and the roller switching mechanism moving the bending roller assembly back and forth along the second direction; and a roller abutting mechanism, the roller switch mechanism movably mounted on the roller abutting mechanism, and the roller abutting mechanism moving the roller switching mechanism back and forth along the third direction.

11. The single bending device as claimed in claim 8, wherein a roller switching mechanism, the bending roller assembly movably mounted on the roller switching mechanism, and the roller switching mechanism moving the bending roller assembly back and forth along the second direction; and a roller abutting mechanism, the roller switch mechanism movably mounted on the roller abutting mechanism, and the roller abutting mechanism moving the roller switching mechanism back and forth along the third direction.

12. The single bending device as claimed in claim 9, wherein a roller switching mechanism, the bending roller assembly movably mounted on the roller switching mechanism, and the roller switching mechanism moving the bending roller assembly back and forth along the second direction; and a roller abutting mechanism, the roller switch mechanism movably mounted on the roller abutting mechanism, and the roller abutting mechanism moving the roller switching mechanism back and forth along the third direction.

13. The single bending device as claimed in claim 4, wherein a third direction is defined perpendicular to the first direction and the second direction; and the third moving assembly has a third direction moving mechanism, the pressing roller head movably mounted on the third direction moving mechanism, and the third direction moving mechanism moving the pressing roller head back and forth along the third direction; and a first direction moving mechanism, the third direction moving mechanism movably mounted on the first direction moving mechanism, and the first direction moving mechanism moving the third direction moving mechanism back and forth along the first direction.

14. The single bending device as claimed in claim 5, wherein a third direction is defined perpendicular to the first direction and the second direction; and the third moving assembly has a third direction moving mechanism, the pressing roller head movably mounted on the third direction moving mechanism, and the third direction moving mechanism moving the pressing roller head back and forth along the third direction; and a first direction moving mechanism, the third direction moving mechanism movably mounted on the first direction moving mechanism, and the first direction moving mechanism moving the third direction moving mechanism back and forth along the first direction.

15. The single bending device as claimed in claim 6, wherein a third direction is defined perpendicular to the first direction and the second direction; and the third moving assembly has a third direction moving mechanism, the pressing roller head movably mounted on the third direction moving mechanism, and the third direction moving mechanism moving the pressing roller head back and forth along the third direction; and a first direction moving mechanism, the third direction moving mechanism movably mounted on the first direction moving mechanism, and the first direction moving mechanism moving the third direction moving mechanism back and forth along the first direction.

16. The single bending device as claimed in claim 1, wherein the bending roller assembly further includes a motor and the motor drives the rollers to rotate.

17. The single bending device as claimed in claim 1, wherein the pressing roller head includes a base having a first extension portion having a first end securely attached to the third moving assembly; and a second end disposed closer to the bending roller assembly than the first end of the first extension portion; and a second extension portion; and a pressing roller having a first end securely attached to the second end of the first extension portion; and a second end disposed closer to the bending roller assembly than the first end of the second extension portion.

18. The single bending device as claimed in claim 2, wherein the pressing roller head includes a base having a first extension portion having a first end securely attached to the third moving assembly; and a second end disposed closer to the bending roller assembly than the first end of the first extension portion; and a second extension portion; and a pressing roller having a first end securely attached to the second end of the first extension portion; and a second end disposed closer to the bending roller assembly than the first end of the second extension portion.

19. The single bending device as claimed in claim 3, wherein the pressing roller head includes a base having a first extension portion having a first end securely attached to the third moving assembly; and a second end disposed closer to the bending roller assembly than the first end of the first extension portion; and a second extension portion; and a pressing roller having a first end securely attached to the second end of the first extension portion; and a second end disposed closer to the bending roller assembly than the first end of the second extension portion.

20. A single bending device for continuous three-dimensional bending, and the single bending device used for bending an elongated workpiece and comprising:

a rotating and feeding holder holding the workpiece;

a first moving assembly moving the rotating and feeding holder back and forth;

a bending roller assembly including at least one roller, each of the at least one roller having an outer annular surface being divided into multiple curved sub-surfaces, and the curved sub-surfaces having different radii of curvature;

a second moving assembly moving the bending roller assembly back and forth to allow the outer annular surface of one of the rollers to abut against the workpiece;

a pressing roller head bending the workpiece; and a third moving assembly moving the pressing roller head back and forth two-dimensionally to allow the pressing roller head to move along the outer annular surface of the roller.

* * * * *